US011148041B1

(12) United States Patent
Ferry

(10) Patent No.: US 11,148,041 B1
(45) Date of Patent: Oct. 19, 2021

(54) LOCKBOX PUZZLE GAME

(71) Applicant: Benjamin L. Ferry, Pasadena, MD (US)

(72) Inventor: Benjamin L. Ferry, Pasadena, MD (US)

(73) Assignee: Lockbox Adventures LLC, Baltimore, MD (US)

( * ) Notice: Subject to any disclaimer, the term of this patent is extended or adjusted under 35 U.S.C. 154(b) by 25 days.

(21) Appl. No.: 16/548,914

(22) Filed: Aug. 23, 2019

Related U.S. Application Data

(60) Provisional application No. 62/879,442, filed on Jul. 27, 2019.

(51) Int. Cl.
*A63F 9/00* (2006.01)
*A63F 9/18* (2006.01)

(52) U.S. Cl.
CPC ..... *A63F 9/001* (2013.01); *A63F 9/183* (2013.01); *A63F 2009/0012* (2013.01); *A63F 2250/24* (2013.01)

(58) Field of Classification Search
CPC ..... A63F 2250/24; A63F 9/001; A63F 9/18; A63F 9/183; A63F 2009/0012
See application file for complete search history.

(56) References Cited

U.S. PATENT DOCUMENTS

| | | | |
|---|---|---|---|
| 430,261 A | 6/1890 | Altemus | |
| 6,320,495 B1 | 11/2001 | Sporgis | |
| 6,682,074 B2 | 1/2004 | Weston | |
| 6,756,882 B2 | 6/2004 | Benes et al. | |
| 6,932,698 B2 | 8/2005 | Sprogis | |
| 7,252,204 B1 | 8/2007 | Small | |
| 8,425,291 B2 | 4/2013 | Counts | |
| 8,428,614 B2 | 4/2013 | Wolfe | |
| 8,517,193 B1 | 8/2013 | Small | |
| 8,795,084 B2 | 8/2014 | Bell et al. | |
| 9,000,890 B1 | 4/2015 | Hart | |
| 9,802,121 B2 | 10/2017 | Ackley et al. | |
| 9,950,248 B2 | 4/2018 | Poisner et al. | |
| 2003/0144047 A1 | 7/2003 | Sprogis | |
| 2005/0288082 A1* | 12/2005 | de la Huerga | A63F 9/0811 463/9 |
| 2008/0039204 A1 | 2/2008 | Ackley et al. | |
| 2011/0010251 A1 | 1/2011 | Silva | |

(Continued)

FOREIGN PATENT DOCUMENTS

AU 2016101835 A4 12/2016

*Primary Examiner* — Werner G Garner
(74) *Attorney, Agent, or Firm* — Hanrahan Law Firm, P.A.; Benjamin M. Hanrahan

(57) ABSTRACT

A lockbox game is presented herein. The game includes a locked container with one or more prizes therein. The locked container, with the cover locked, is provided to a participant along with a series of puzzles. The participant is required to solve the puzzles in order to collectively reveal a lock code that can be used to open the locked container and retrieve the one or more prizes therein. The game can be presented in a number of different versions, including a stationary or tabletop version and a travel version. A mobile application may be used to display puzzles, convert puzzle solutions to portions of the lock code, or reveal locations to which the participant must travel during the game.

10 Claims, 16 Drawing Sheets

(56) References Cited

U.S. PATENT DOCUMENTS

| | | | | |
|---|---|---|---|---|
| 2011/0201432 | A1* | 8/2011 | Waldock | A63F 9/24 463/46 |
| 2015/0174481 | A1 | 6/2015 | Tobin | |
| 2015/0336010 | A1 | 11/2015 | Wiederkehr | |
| 2016/0107084 | A1 | 4/2016 | Kuri et al. | |
| 2019/0015747 | A1 | 1/2019 | Thompson et al. | |

* cited by examiner

LOCKBOX PUZZLE GAME

CLAIM OF PRIORITY/CROSS-REFERENCE TO RELATED APPLICATION

The present application is based on and a claim of priority is made under 35 U.S.C. § 119(e) to provisional patent application Ser. No. 62/879,442, filed on Jul. 27, 2019, the content of which is incorporated herein in its entirety by reference.

FIELD OF THE INVENTION

The present invention is generally directed to a lockbox game, and more specifically, to a game which includes a locked container with one or more prizes therein. A participant will solve a series of puzzles in order to collectively reveal a code that can be used to open the locked container and retrieve the one or more prizes therein. The game can be presented in a number of different versions, including a stationary or tabletop version and a travel version. Some embodiments of the game, and particularly the travel version but also the stationary or tabletop version, may operate in combination with a mobile application.

BACKGROUND OF THE INVENTION

People are often looking for new games, challenges, rewarding experiences, gift ideas or motivation to travel to different areas of a town or city. There is, thus, almost always a need for a new challenging puzzle game and adventure kit that can not only be given as a gift, but can be used to organize events with friends or family.

Specifically, the proposed lockbox puzzle game can be played in a number of different ways, for example, in the comfort of one's own home via the stationary or tabletop version, or by traveling to different locations successively revealed by the game via the travel or mobile version.

SUMMARY OF THE INVENTION

Accordingly, the present invention is generally directed to a lockbox game which includes a locked container with one or more prizes therein. In many cases, the container is locked with a combination lock that requires a three or four digit lock code to open. The containers are filled with one or more prizes and locked before providing the containers to any participants.

In addition to the locked container, the participant is also provided with a number of different puzzles that must be solved in order to reveal the lock code. In one embodiment, the puzzles are provided in physical form, meaning that the puzzles are printed or displayed on paper, card(s), or other physical and tangible medium. This allows the participant to solve the puzzles at home, in their own time and at their leisure.

Other embodiments may require or allow the participant to download and install a mobile application on a smartphone or tablet. The mobile application may be used to access the puzzles instead of or in addition to having the physical written versions. In some cases, the participant may need to scan a Quick Response (QR) code or other like code in order to synchronize the mobile application with the particular locked container. This is because the solutions to the puzzles will be used to determine the lock code. Thus, it is imperative that the puzzles provided to the participant match the locked box.

Furthermore, the locked containers may be themed, meaning that the puzzles and the prize(s) may match a common theme, for example, holiday themes (Christmas, Easter, Independent Day, New Year's Day, etc.), sports teams, etc. This can help ensure that participants do not receive duplicate containers from a subsequent purchase or adventure.

For the travel version of the game, the mobile application will deliver a puzzle to the participant upon scanning the QR code. Correctly solving the puzzle and entering the puzzle solution into the application will reveal a location to which the participant must travel in order to receive further puzzles. For instance, the participant will travel to the revealed location, and upon doing so, the application will recognize the participant's location via GPS, geofencing or other location base capabilities or technology.

In some embodiments, upon arriving at the location, two puzzles or two groups of puzzles are provided to the participant. Correctly solving and entering the puzzle solution to one of the puzzles or groups of puzzles will reveal the next location, whereas correctly solving the other puzzle or group of puzzles will reveal a portion of the lock code (for example, one digit of the lock combination). The participant will travel to additional locations, specified by the application, until all of the lock code is revealed. When the participant is at the last location, no other locations are revealed.

Furthermore, in order to ensure the participant is able to open the locked container, some embodiments may include or allow for clues to be revealed. For instance, in some embodiments, there may be some clues at each location, in the event the participant is unable to solve the puzzle. In at least one embodiment, the participant may be able to quit or retrieve the puzzle solution to any one or all of the puzzles, for instance, in the event he or she is unable to solve the puzzle(s).

Additional embodiments may include filling a vault or home security safe with hand selected prizes. The participant is then required to complete a series of custom-tailored activities in order to gain access to the safe or container. The activities may be different than solving puzzles. For example, once a participant has selected to participate or has elected to participate, detailed information about the participant is provided or obtained. Using the detailed personal information, (e.g., likes, dislikes, concerns, allergies, etc.) an elaborate adventure is custom tailored to their interests.

The activities can vary from one participant to another. For example, however, a user might be required to visit a nearby race track and drive a super car around a track, go skydiving, surfing, or any number of other unusual and fun activities. Upon successful completion of each activity, the user will then be granted a single digit associated with the event. In some cases, the participant will be required to participant in four or more experiences or activities before gaining access to the safe.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

As shown in the accompanying drawings, the present invention is generally directed to a puzzle game that includes an initially locked container, represented as 10. Particularly, as described in accordance with the various embodiments of the present invention, the locked container 10 is provided to a participant who must solve a series of puzzles in order to eventually obtain a lock code that can be used to unlock the locked container 10. When the locked container 10 is opened, access to one or more prizes or items 20 is provided.

The puzzles, in some embodiments, can be provided to the participant in a physical or tangible form, such as by being printed on physical cards or paper, while in other embodiments, the puzzles can be displayed on a mobile device via a mobile application, on a website, computer, etc. Furthermore, as described in more detail hereinafter, in some cases, the puzzle solution may directly correspond to a portion of the lock code, while in other cases, the puzzle solution may need to be converted into the portion of the lock code. This conversion of the puzzle solution to the portion of the lock code can be performed manually via a predetermined algorithm, process, instructions or look-up table, or it may be performed by the mobile application or website via a predetermined algorithm, process, instructions or look-up table.

Figure 1A:
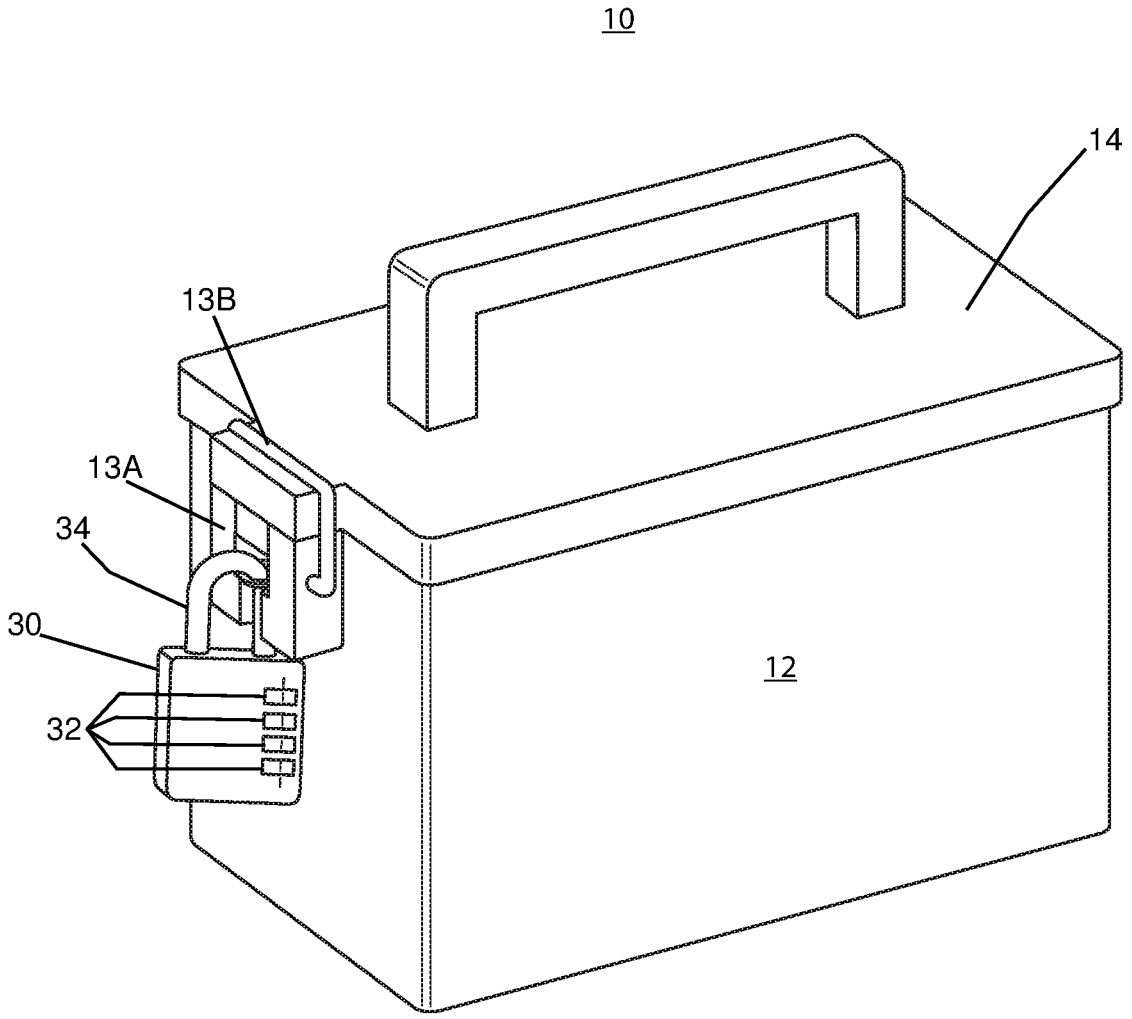
FIG. 1A is a perspective view of an exemplary locked container with the cover in a closed and locked position, as disclosed in accordance with at least one embodiment of the present invention.
Figure 1B:
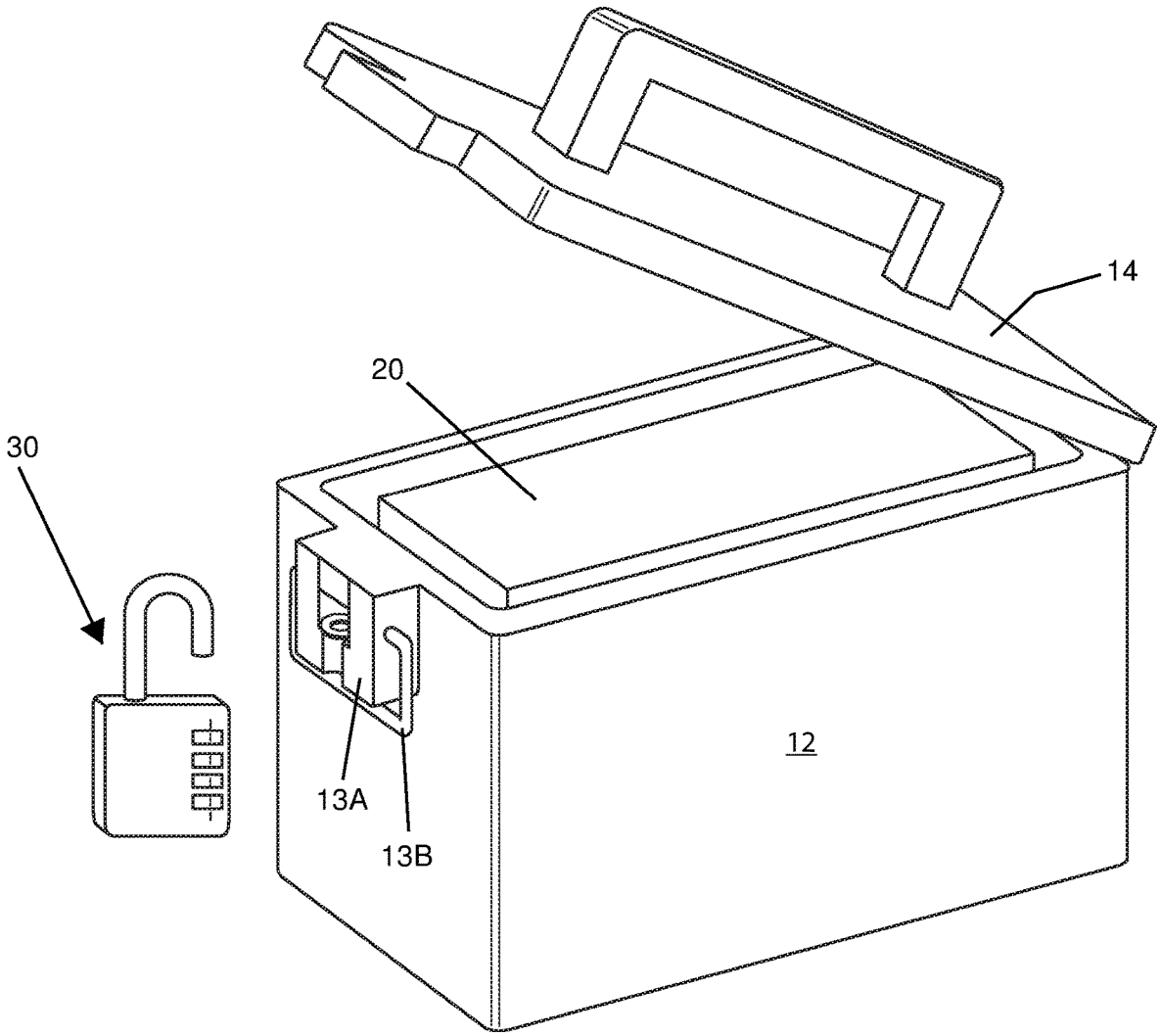
FIG. 1B is a perspective view of an exemplary locked container with the cover is an open position.
Figure 1C:
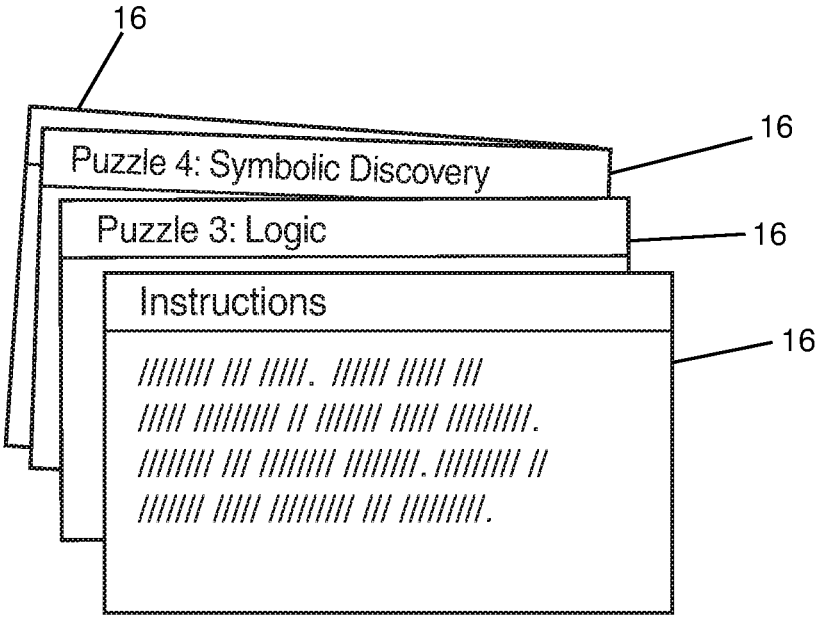
FIG. 1C is a top view of a plurality of exemplary cards displaying different puzzles and instructions, as disclosed herein.

With reference now to FIGS. 1A and 1B, an exemplary locked container 10 is illustrated. For example, the locked container 10 of at least one embodiment may include a base 12 and a cover 14. The base 12 will generally include an interior portion 15 within which one or more prize items 20 may be disposed. The size of the container 10 may vary and the type of prize or item 20 therein is virtually limitless. As just an example, the locked container 10 may in some embodiments be the size of a medium tackle box or plastic ammo can and the prize(s) or item(s) disposed therein can range from a coupon, gift card/certificate, travel voucher, toys, stuffed animals, jewelry, etc. The scope of the present invention is neither limited by the size or the prizes shown or described herein.

In any event, still referring to FIGS. 1A and 1B, the game of at least one embodiment includes a lock 30 that is structured and configured to lockingly dispose the cover 14 of the container 10 to the base 12. In the embodiment shown, the cover 12 is represented as a lid on the top of the base 12, the lid or cover 14 being pivotal to the base 12 such that, when the lock is removed or unlocked, the cover 14 can pivot open revealing the contents inside. Other embodiments may include a different cover that is completely removable from the base, slidingly positioned between an open and a closed position, rotatably positioned between an open and a closed position, a door on the side or end of the container, etc. Either way, the lock 30 is configured to retain the cover 14 in the closed position (restricting or preventing access to the interior portion 15) unless and until the lock is unlocked and/or in some cases removed.

For example, the lock 30 illustrated in the exemplary embodiment of FIGS. 1A and 1B is a combination lock in which a number of dials 32 representing a series of symbols or numbers (digits) are manually rotated and/or aligned in order to open or unlock the lock 30. In this manner, the lock 30 includes a lock code which, in at least one embodiment, is a series or sequence of symbols, letters, numbers, digits, characters, words, etc. that unlock the lock 30. As an example, a lock code may be a 4-digit code, such as 4-3-9-2, in that order. In the case of many combination locks, the lock code may be four single-digit numbers, however, the scope of the various embodiments of the present invention is not limited to such. For instance, other lock codes within the scope of the present invention may be more or less than four symbols, letters, numbers or digits. It is also contemplated that in some embodiments, the lock code may be a series of words or a series of alphanumeric codes not limited to single digits or characters.

Furthermore, still referring to FIGS. 1A and 1B, the combination lock shown is external to the container 10, meaning that the entire lock 30 or locking mechanism is accessible external to the container 10. The lock 30 illustrated in the exemplary embodiment includes a shackle 34 that is passed through a locking ring or hole. When the lock 30 is in the locking ring, the handle 13A cannot pivot outward, and therefore, the locking band 13B cannot move into or out of the locked position as shown in FIG. 1A. The present invention, however, is not limited to the structure of the container 10 as illustrated in FIGS. 1A and 1B. For example, in some cases, the lock 30 may pass through corresponding holes or openings in the cover 14 and the base 12. With the lock in such a position and locked shut, the cover 14 is not able to be moved into the open position.

Even further locking mechanisms are contemplated within the full spirit and scope of the present invention. For example, the lock may be integral with or built into the container 10. In some cases, the lock may be at least partially internal, meaning that at least some of the locking components that lock the cover 14 to the base 12 may be internal and/or otherwise not accessible external to the container 10. The lock may, in some cases, be digitally operable or manually operable.

In addition, the game of the various embodiments disclosed herein includes a plurality of puzzles, each of which can be solved with a corresponding puzzle solution. The term puzzle is used broadly and can include but is in no way limited to brain teasers, logic games, logic puzzles, riddles, trivia questions, math questions, etc. In some cases, the participant may need to have some knowledge of history, geography, sports, or pop culture. Some puzzles may be enigmatic puzzles that have no defined rules; however, the participant must figure out how to solve it anyway.

With reference to FIGS. 1C, 2A, 2B, 2C and 2D, some embodiments include one or more physical or tangible medium 16 upon which to display the puzzles 40A, 40B, 40C, 40D. As just an example, the one or more puzzles 40, 40A, 40B, 40C, 40D may be printed or otherwise displayed on paper, cardstock, paper stock, cardboard, construction paper, etc. In other words, the medium 16 upon which the puzzles 40, 40A, 40B, 40C, 40D are printed or displayed may, in at least one embodiment, include virtually any physical medium or structure.

In some embodiments, as shown in FIGS. 3A, 3B, 3C and 3D, the puzzles 40A, 40B, 40C, 40D may be provided to the participant or otherwise displayed on a computer, including a desktop computer, laptop computer, tablet, or mobile device 50, including, for example, a smartphone such as but not limited to an APPLE® iPHONE®, SAMSUNG® mobile phone, GOOGLE® based mobile device, etc.

In this manner, the mobile or other user device 50 may include, among other components and devices structured to facilitate implementation of the present invention in the intended manner, a computer processor, memory, data storage device, and a communication or network device. In some embodiments, the mobile or user device may need location services or capabilities including a Global Positioning System. The processor, as used herein, may include any device cooperatively structured to implement or execute computer instructions, software, etc., for example, the methods described herein and the mobile application described herein. The data storage device may include a hard disk drive, solid state drive, virtual drive, cloud drive, or other volatile or non-volatile memory. The memory, as used herein, may include, but is not limited to random access memory (RAM) or other like devices or structured configured to implement the present invention in the intended manner, for example, by storing and assisting with the execution of one or more application, modules or components of the method and mobile application disclosed herein. It should also be noted that non-transitory computer readable media includes all computer-readable media except for a transitory, propagating signal.

Figure 4:
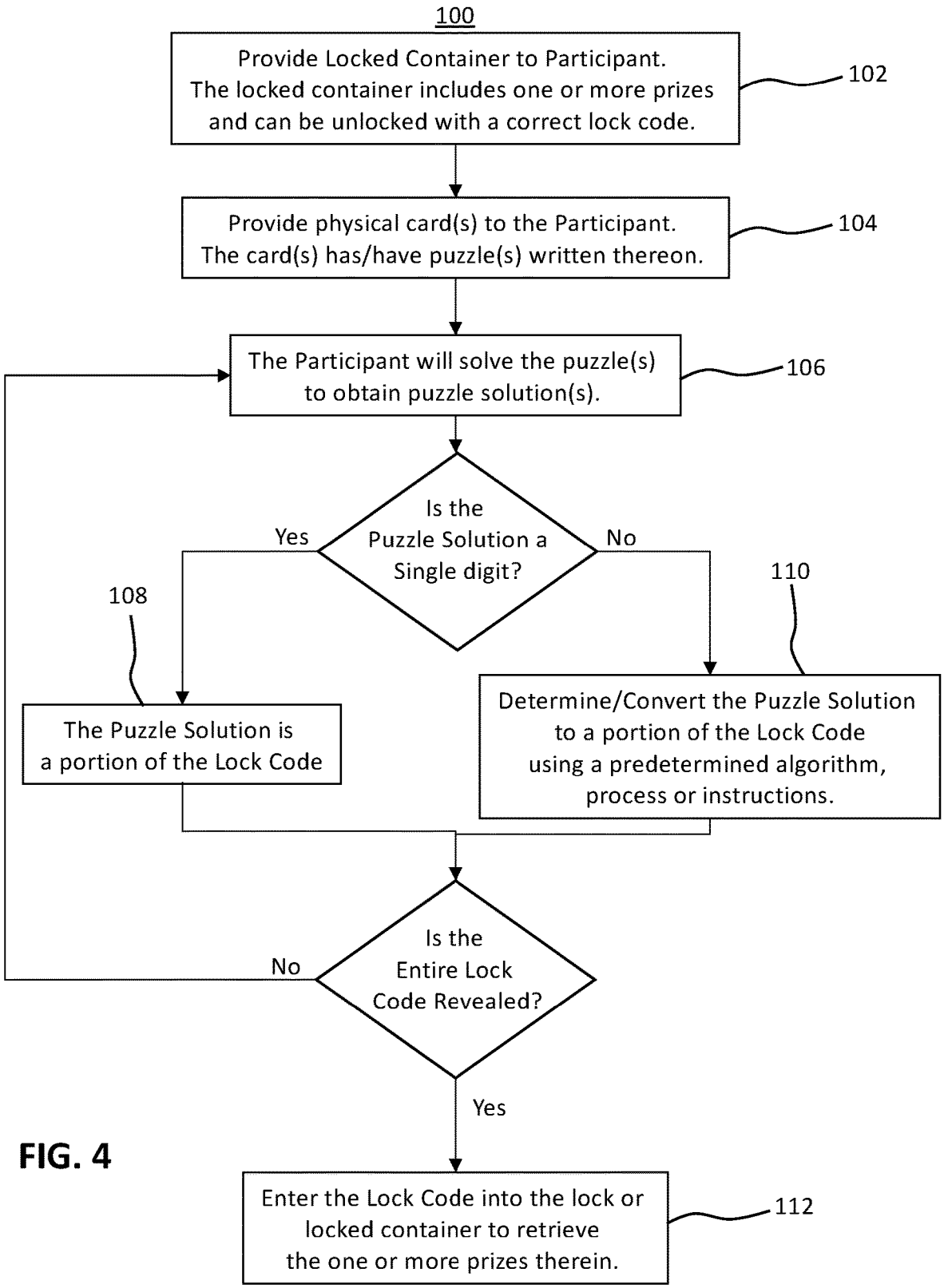
FIG. 4 is a flow chart illustrating a method of providing a lockbox puzzle game as disclosed in accordance with at least one embodiment.

With reference now to FIG. 4, one method 100 of implementing the game or adventure of at least one embodiment of the present invention is illustrated. For example, as shown at 102, the game or adventure may begin by providing a locked container 10 to a participant. In some cases, the locked container 10 may be provided to a participant as a gift, although the invention is not limited to such. For example, it is also contemplated that an event can be scheduled where a plurality of participants each receive their own locked container 10, with each of the locked containers 10 including a different prize or the same prize inside. In this manner, the participants are given a container 10 that is initially locked when they receive it, and each participant must figure out how to unlock it by solving puzzles, as described herein.

For instance, in at least one method 100, and as shown at 104 in FIG. 4, the participant(s) is/are provided with one or more physical cards or other physical medium upon which the puzzles are printed or displayed. Exemplary cards 16 are illustrated in FIGS. 1C and 2A-2D.

Next, as shown at 106, the participant(s) will solve the puzzles to obtain a puzzle solution. The puzzle solution(s) is/are then used to determine the lock code for unlocking the locked container 10. In some embodiments, the puzzles may be numbered, labeled or ordered in some way to indicate to the participant in which order the puzzle solutions translate to the lock code. In other words, the puzzles or cards may be ordered (e.g., via labelling, numbering or positions on a page) such that the puzzle solutions are ordered to match the order of the lock code.

For instance, as shown in FIGS. 2A-2D, there are a plurality of separate cards 16 each with a different puzzle. The cards 16 are labeled "Puzzle 1 . . . ," "Puzzle 2 . . . ," "Puzzle 3 . . . ," and "Puzzle 4 . . . " This indicates to the participant that the solution to puzzle 1 40A will determine the first digit or first character in the lock code, the solution to puzzle 2 40B will determine the second digit or second character in the lock code, the solution to puzzle 3 40C will determine the third digit or third character in the lock code, and the solution to puzzle 4 40D will determine the fourth digit or fourth character in the lock code. In other cases, a single card or physical medium may contain a plurality of puzzles. In that case, the puzzles may be ordered or positioned on the page to indicate the order in which the solutions match the lock code. It should be noted, however, that in some cases the puzzles may not be labeled or ordered in a way to correspond to the order of the lock code. This would add some difficulty to the game.

In some cases, the lock code may include a format of four single digits, although, as mentioned above, other code formats are contemplated. As shown at 108, if the puzzle solution of one of the puzzles matches or correlates with the format of the lock code (e.g., if the lock code includes four single digits and the puzzle solution is a single digit, or if the lock code has a series of double digits and the puzzle solution is a double digit), then the puzzle solution can equal or otherwise be a portion of the lock code. However, as shown at 110, if the puzzle solution does not match or correlate with the format of the lock code, then the puzzle solution will need to be converted or translated into a portion of the lock code using a predetermined algorithm or process.

An exemplary algorithm or process for converting the puzzle solution to a portion of the lock code can include, but is not limited to the following. If the puzzle solution is multiple digits (e.g., two or more digits), then each digit is added together continuously until only a single digit remains. The remaining single digit will then be the portion of the lock code. As an example, if the puzzle solution is 97, the process would first add 9 to 7, which equals 16 (9+7=16). Since 16 is still multiple digits, the process would continue by adding 1 to 6, which equals 7. In this example, 7 would be a portion of the lock code.

Furthermore, continuing the exemplary algorithm or process, if the solution is one or more letters, words or alphanumeric combinations, the process will begin by converting the letters into numbers. This can be done a number of different ways, for example, by replacing all or some of the letters with its position in the alphabet (e.g., a=1, b=2, c=3, d=4, . . . x=24, y=25, z=26). In other cases, there may be a different look-up table, converter, or cipher to convert letters to numbers. Once the designated letters are converted to numbers, if a single digit remains, then that single digit may be the lock code. If there are multiple numbers or digits, the process may continue by adding the numbers together continuously until only a single digit remains. The remaining single digit will then be the portion of the lock code.

In one case, the process may take the numeric value of the first and last letter of each word. For example, if the solution is "Challenge Me," the process will begin by converting the first and last letter of each word into numbers, which in some embodiments may become 3, 5, 13, 5. These are then added together (3+5+13+15) which equals 26. Since 26 is still a multiple digit number, the process continues by adding 2+6, which equals 8. In this example, 8 will be a portion of the lock code.

In other cases, the process may include converting all of the letters to numbers, or converting only the first letter, or the first and second letter, etc.

Furthermore, in at least one embodiment, a look-up table may be provided to convert a solution (e.g., a number, words, letter, etc.) to a portion of the lock code.

In addition, there may be more puzzles that there are portions of the lock code. For example, if the lock code is four single digit numbers, the game may have more than four puzzles. In that case, the instructions or algorithm may require the participant to aggregate the solutions to multiple puzzles (e.g., using the exemplary process above) to finally achieve a single digit. This allows for a lengthened game experience.

Figure 2A:
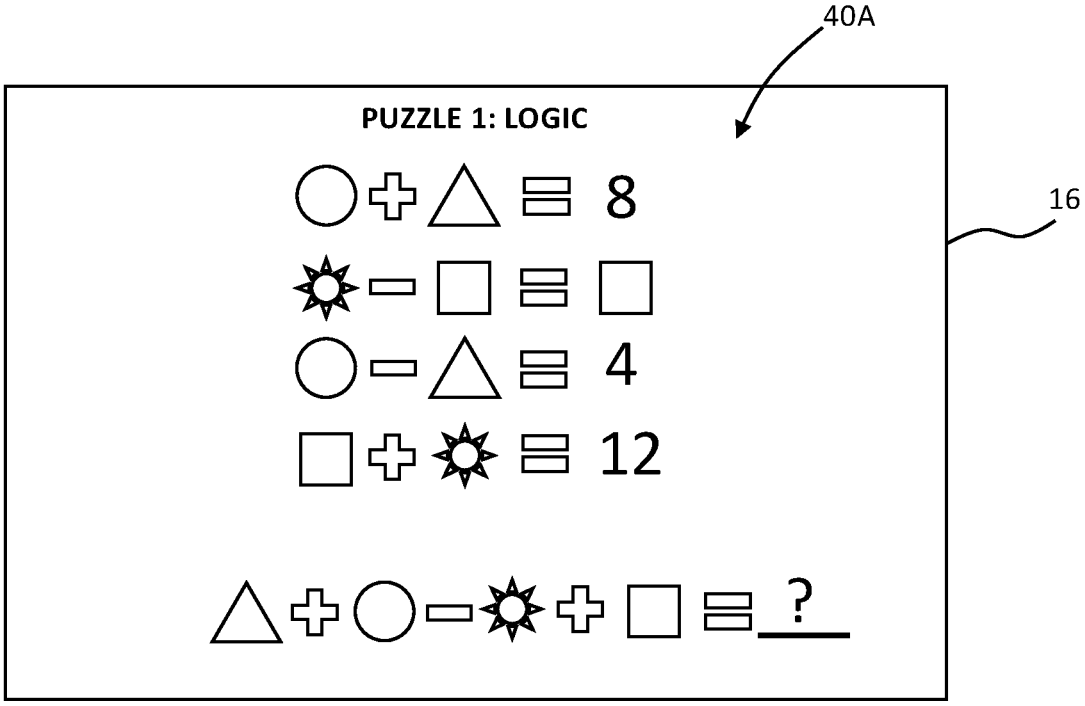
FIG. 2A is an exemplary puzzle displayed on a physical medium as disclosed in accordance with at least one embodiment of the present invention.
Figure 2B:
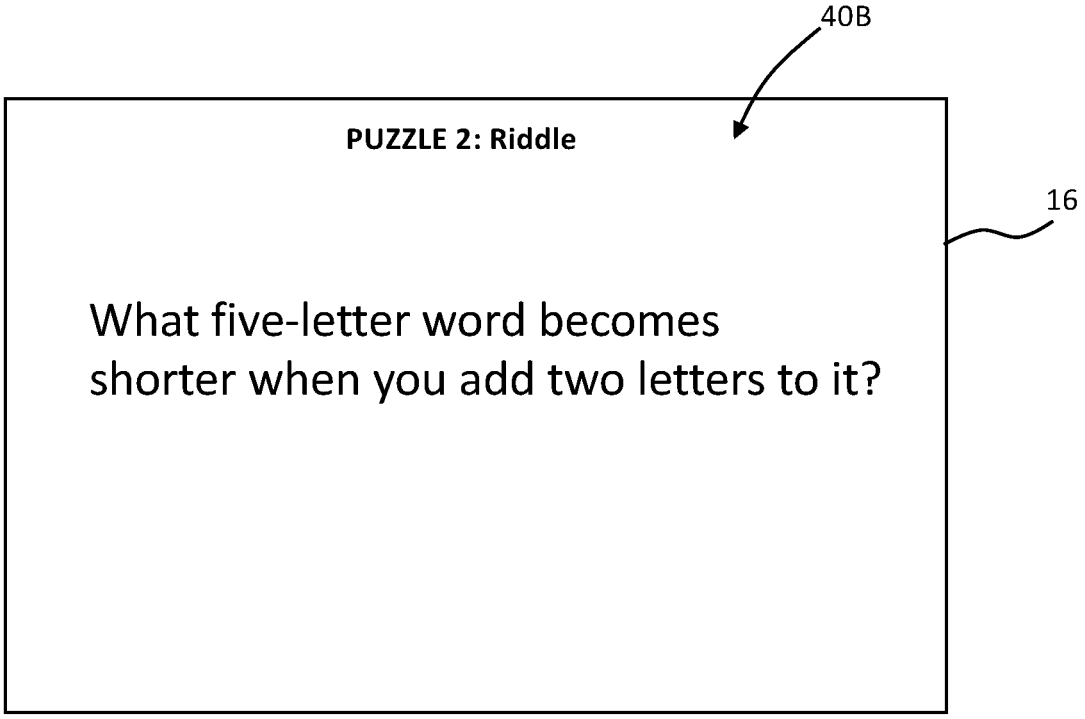
FIG. 2B is another exemplary puzzle displayed on a physical medium as disclosed in accordance with at least one embodiment of the present invention.
Figure 2C:
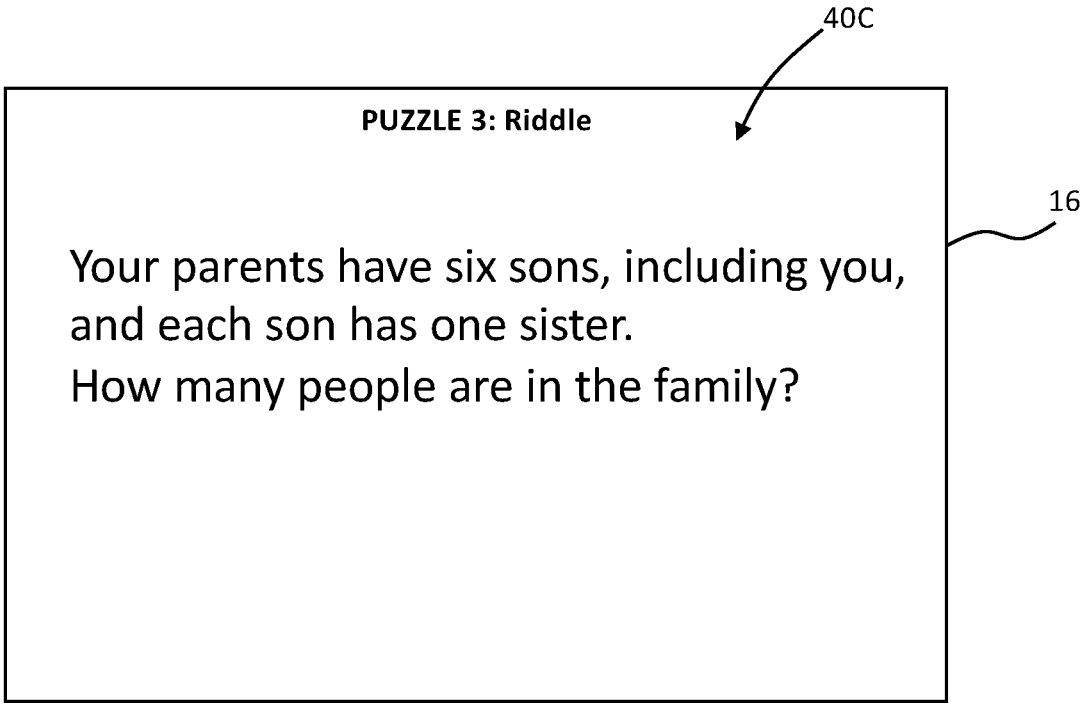
FIG. 2C is another exemplary puzzle displayed on a physical medium as disclosed in accordance with at least one embodiment of the present invention.
Figure 2D:
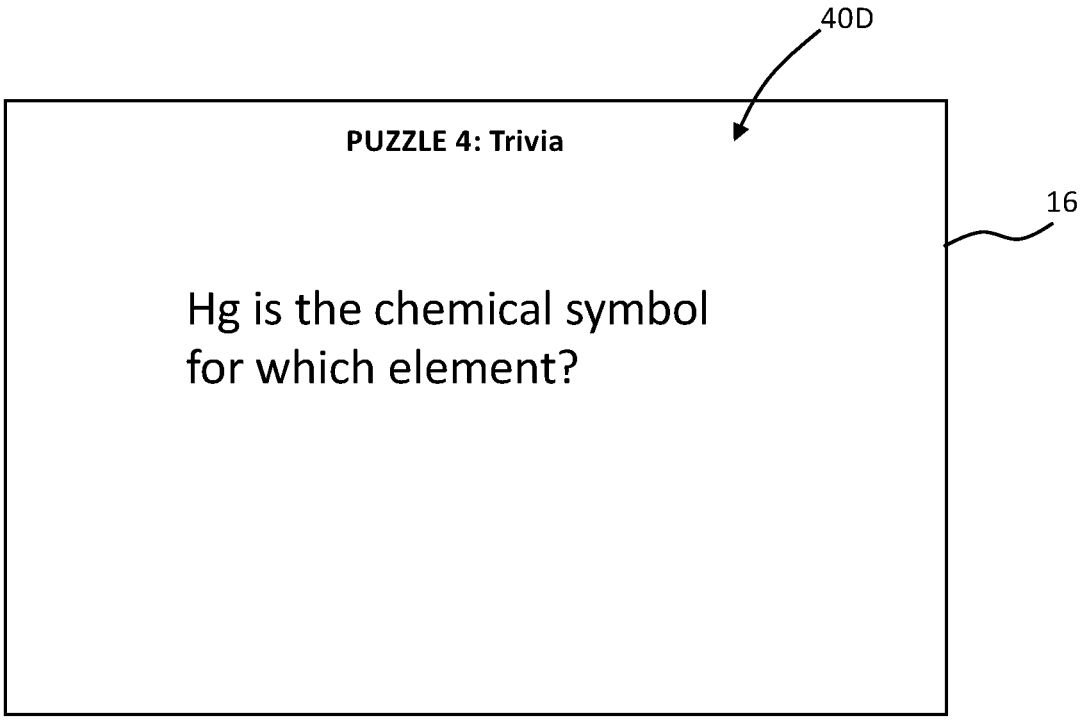
FIG. 2D is another exemplary puzzle displayed on a physical medium as disclosed in accordance with at least one embodiment of the present invention.
Figure 3A:
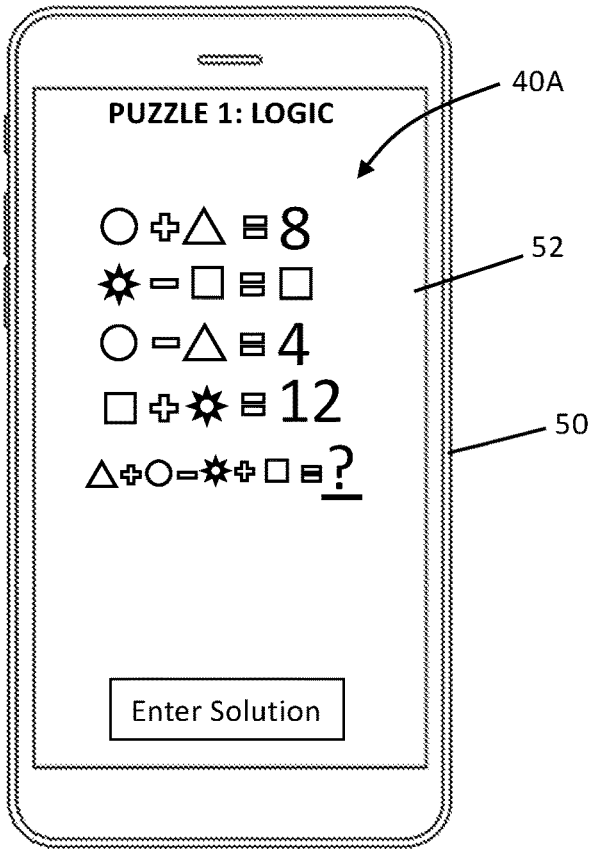
FIG. 3A is an exemplary puzzle displayed on a mobile device via a mobile application, as disclosed in accordance with at least one embodiment of the present invention.
Figure 3B:
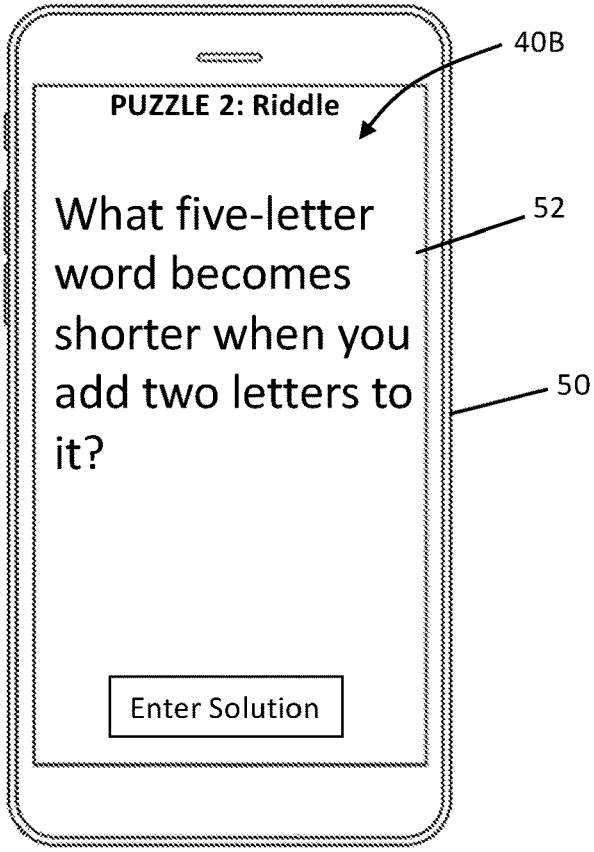
FIG. 3B is another exemplary puzzle displayed on a mobile device via a mobile application, as disclosed in accordance with at least one embodiment of the present invention.
Figure 3C:
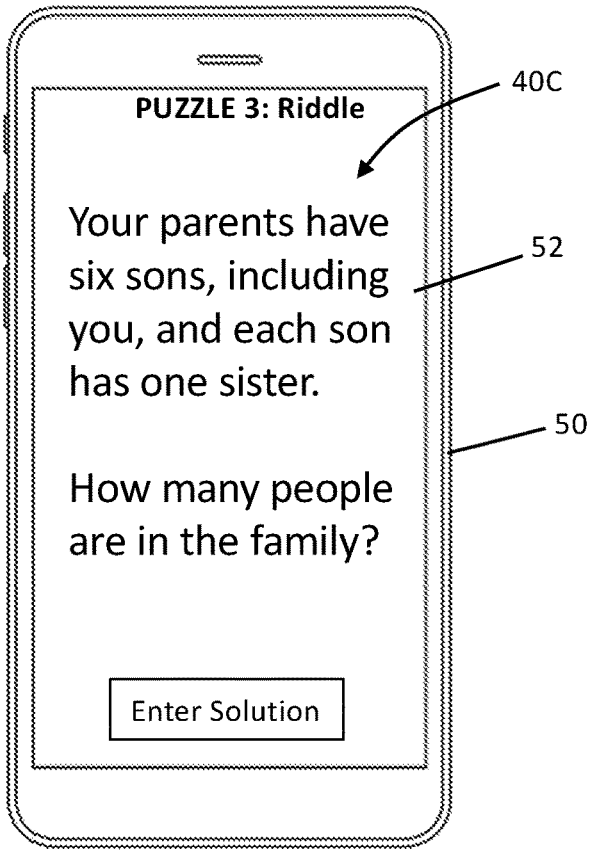
FIG. 3C is another exemplary puzzle displayed on a mobile device via a mobile application, as disclosed in accordance with at least one embodiment of the present invention.
Figure 3D:
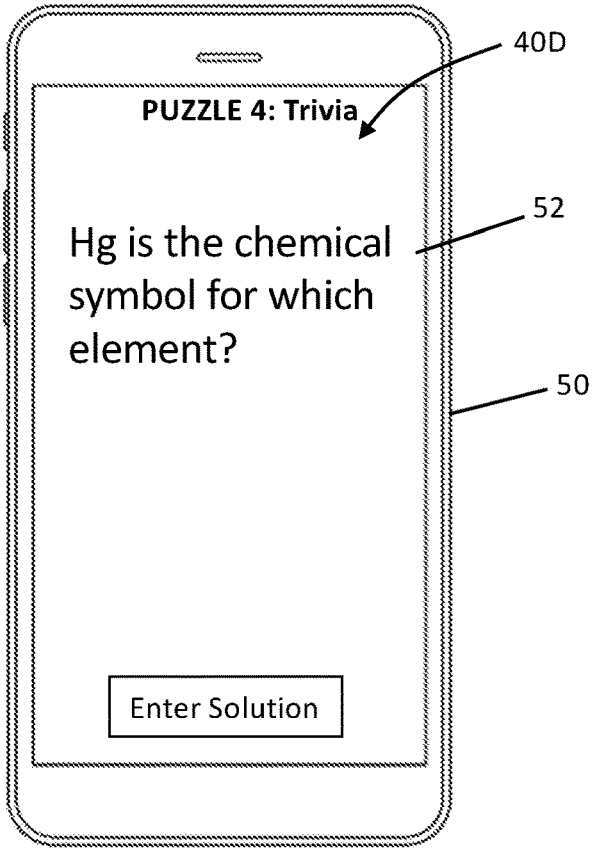
FIG. 3D is another exemplary puzzle displayed on a mobile device via a mobile application, as disclosed in accordance with at least one embodiment of the present invention.

Turning to the exemplary puzzles shown in FIGS. 2A and 2D, the solutions are as follows: Solution to "Puzzle 1" 40A (FIG. 2A) is 4, the solution to "Puzzle 2" (FIG. 2B) 40B is "short," the solution to "Puzzle 3" 40C (FIG. 2C) is 9, and the solution to "Puzzle 4" 40D (FIG. 2D) is "mercury." Using the exemplary conversion process above, the first portion of the lock code is '4', the second portion of the lock code is '3' (s=19, t=20, 19+20=39, 3+9=12, 1+2=3), the third portion of the lock code is '9', and the fourth portion of the lock code is '2' (m=13, y=25, 13+25=38, 3+8=11, 1+1=2).

Turning back to the method 100 of FIG. 4, as shown at 112, once the entire lock code is revealed, the participant can use that lock code to unlock the container 10, for example, by entering the lock code into the lock 30. This allows access to the interior portion of the container where the prize is located.

Figure 5:
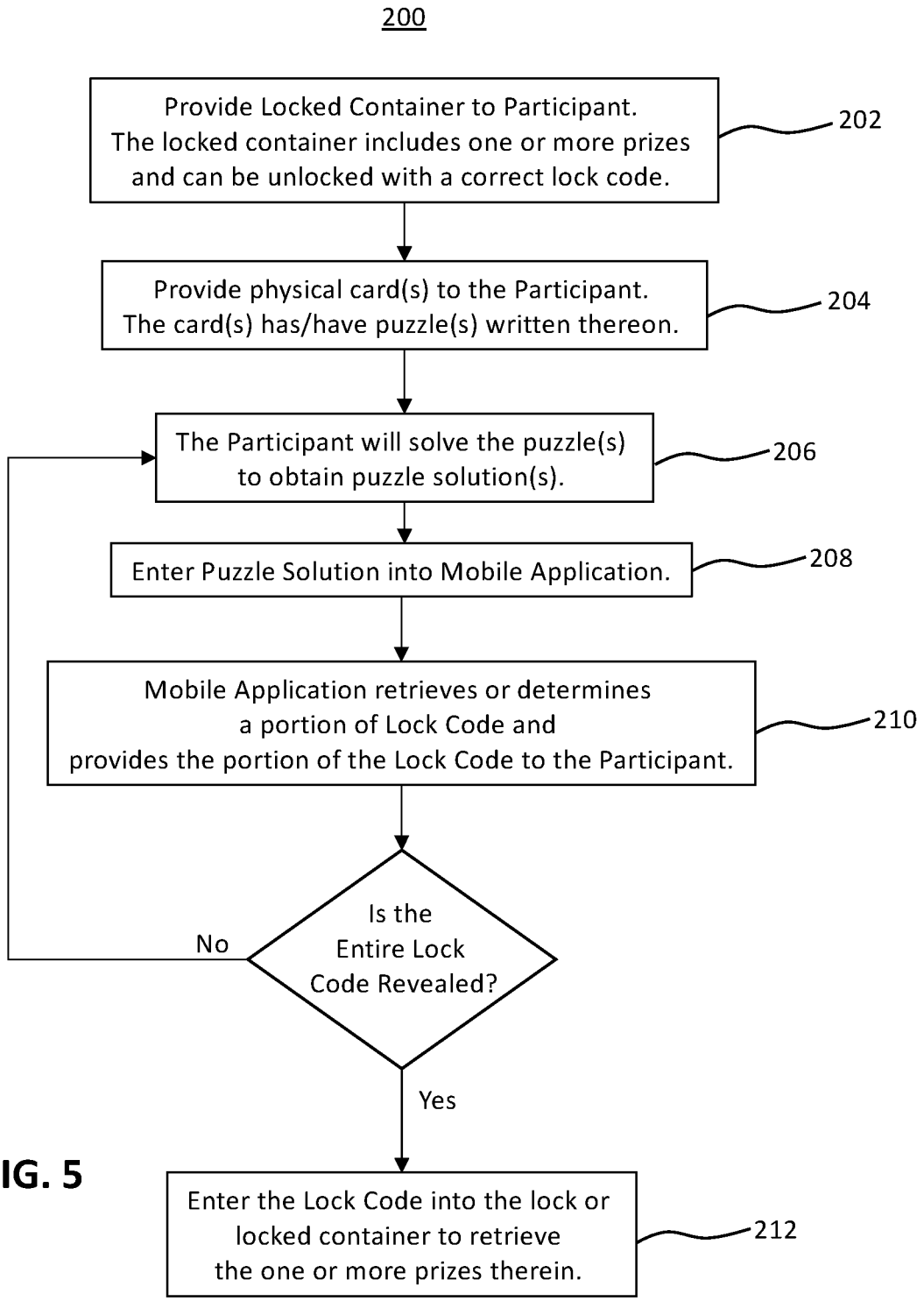
FIG. 5 is a flow chart illustrating another method of providing a lockbox puzzle game as disclosed in accordance with at least one embodiment.

FIG. 5 illustrates another exemplary method 200 of the present invention. In this method 200, the participant is provided a locked container 202 and a plurality of puzzles in physical or tangible form 204, similar to 102 and 104 discussed above. Once the participant solves the puzzle(s) to obtain the puzzle solutions 206 he/she may enter the solutions into a mobile application or website 208. The mobile application or website will then receive the entered puzzle solutions and, using a conversion module, determine the lock code or a portion of the lock code therefrom 210. In this manner, instead of manually converting the puzzle solutions to portion(s) of the lock code using a predetermined process, algorithm or instructions, in at least one embodiment, the process can be automated by a mobile application, website, etc.

The mobile application, website, etc. can use a multitude of different algorithms, processes, instructions, tables or conversion modules to determine a portion of the lock code from the puzzle solution. In one embodiment, the mobile application, website, etc. may use the same or similar process exemplified above.

Figure 6A:
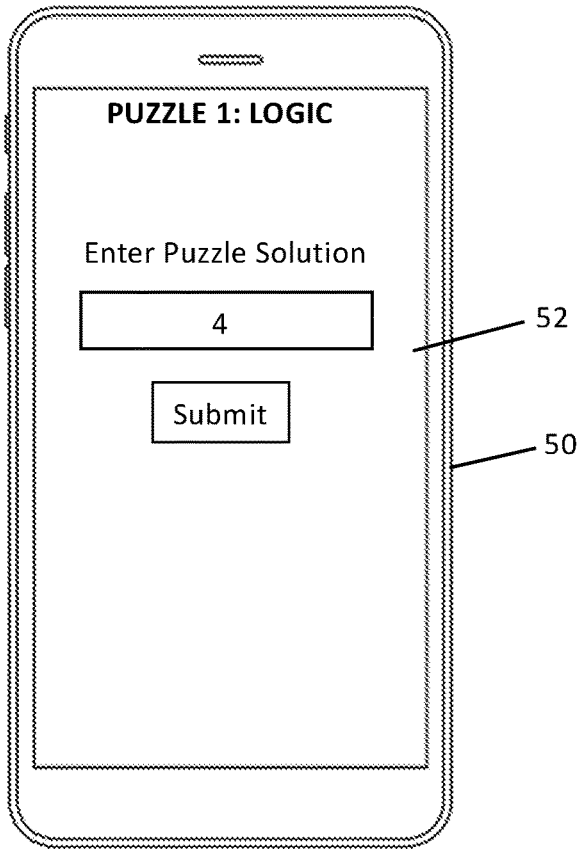
FIG. 6A is an exemplary screenshot of a mobile application receiving a puzzle solution as disclosed herein.
Figure 6B:
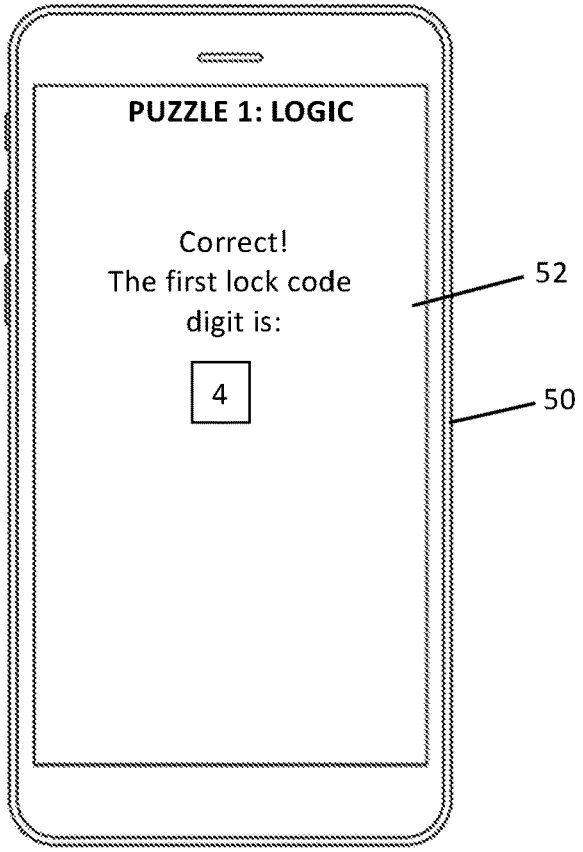
FIG. 6B is an exemplary screenshot of a mobile application converting the puzzle solution shown in FIG. 6A to a portion of the lock code, as disclosed herein.
Figure 6C:
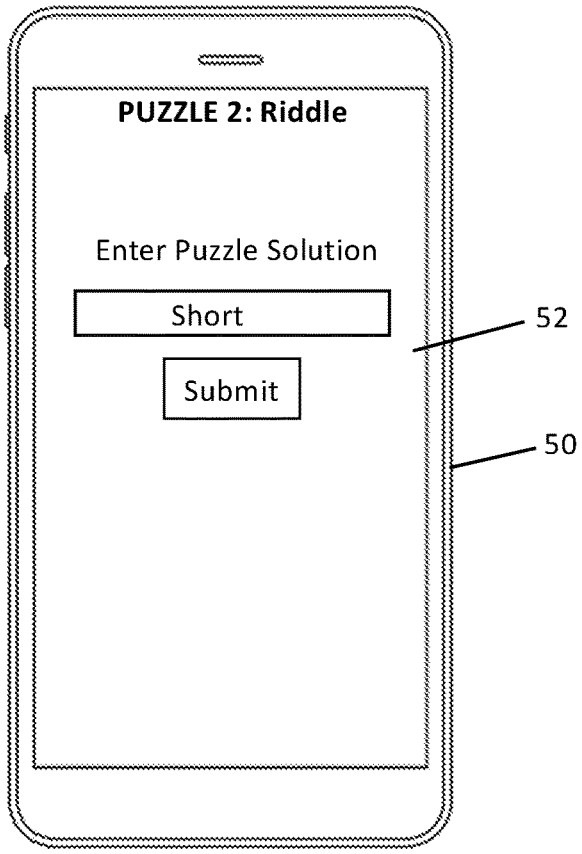
FIG. 6C is an exemplary screenshot of a mobile application receiving a puzzle solution as disclosed herein.
Figure 6D:
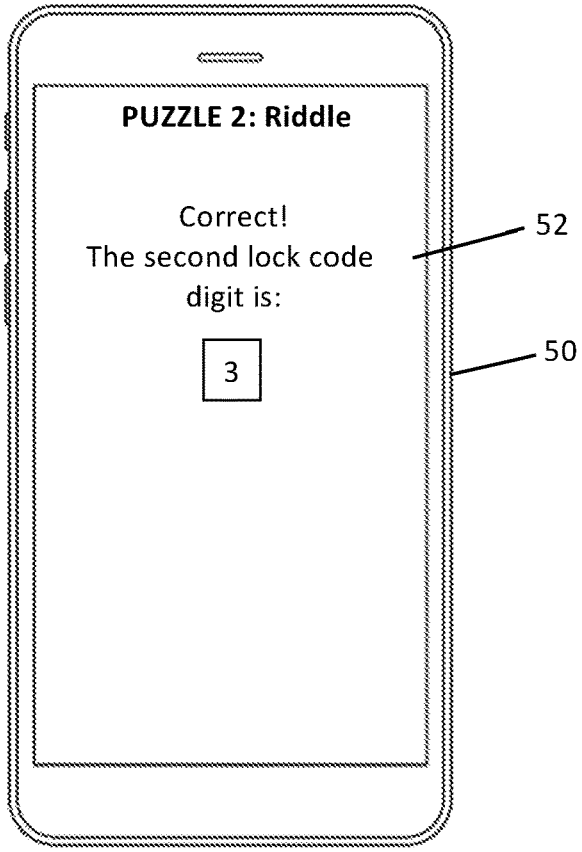
FIG. 6D is an exemplary screenshot of a mobile application converting the puzzle solution shown in FIG. 6C to a portion of the lock code, as disclosed herein.

FIGS. 6A, 6B, 6C and 6D illustrate exemplary screenshots showing the mobile application converting the solutions to portions of the lock code or otherwise determining a portion of the lock code from the puzzle solution(s). Specifically, FIGS. 6A and 6B show a participant entering "4" as the puzzle solution into a conversion module, which determines that "4" is the portion of the lock code to be used. Similarly, FIGS. 6C and 6D illustrate a participant entering "short" as the puzzle solution into the conversion module, which determines that "3" is the portion of the lock code to be used.

Again, once the entire lock code is determined, the participant will enter the lock code into the locked container to retrieve the prize, as shown at 212.

Figure 7:
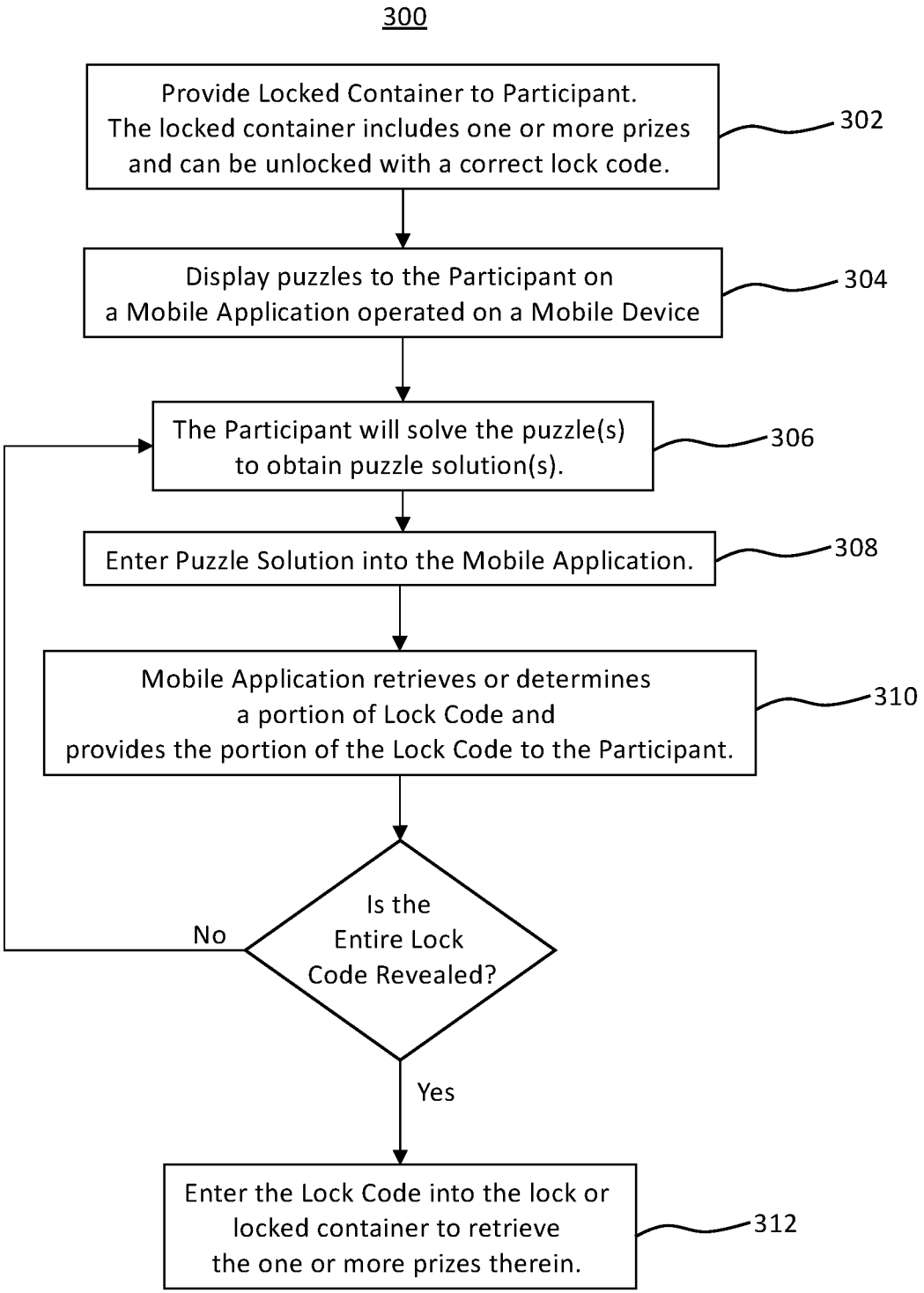
FIG. 7 is a flow chart illustrating another method of providing a lockbox puzzle game as disclosed in accordance with at least one embodiment.

FIG. 7 illustrates yet another method 300 of at least one embodiment of the present invention. For example, in this embodiment, the participant is provided a locked container 302, similar to 102 and 202 discussed above, however, as shown at 304, the puzzles 40A, 40B, 40C and 40D are displayed to the participant via a mobile application 52. For instance, in some cases, the participant may need to download and install a mobile application on his or her smartphone in order to complete the game. Other embodiments may provide the participants with a mobile device that has a mobile application 52 installed or operated thereon.

Furthermore, the locked container 10 may include an image or code, such as but not limited to a Quick Response (QR) code. The participant may scan the QR code 502 with the mobile device 50 in order to synchronize the mobile device to the particular locked container 10. For example, the QR code may contain identifying or unique information relative to the particular locked container 10 which will synchronize with the mobile application 52 or otherwise tell the mobile application 52 what puzzles will need to be displayed to the participant. Of course, the solutions to the puzzles are used to decipher or determine the lock code, so it is important to make sure that the puzzles shown to the participant will match the locked container 10.

Once the participant solves the puzzle(s) to obtain the puzzle solutions 306 he/she may enter the solutions into a mobile application or website 308. The mobile application or website will then receive the entered puzzle solutions and, using a conversion module, determine the lock code or a portion of the lock code therefrom 310, similar to that discussed above with reference to 210. Similarly, once the entire lock code is determined, the participant will enter the lock code into the locked container to retrieve the prize, as shown at 312.

Figure 8:
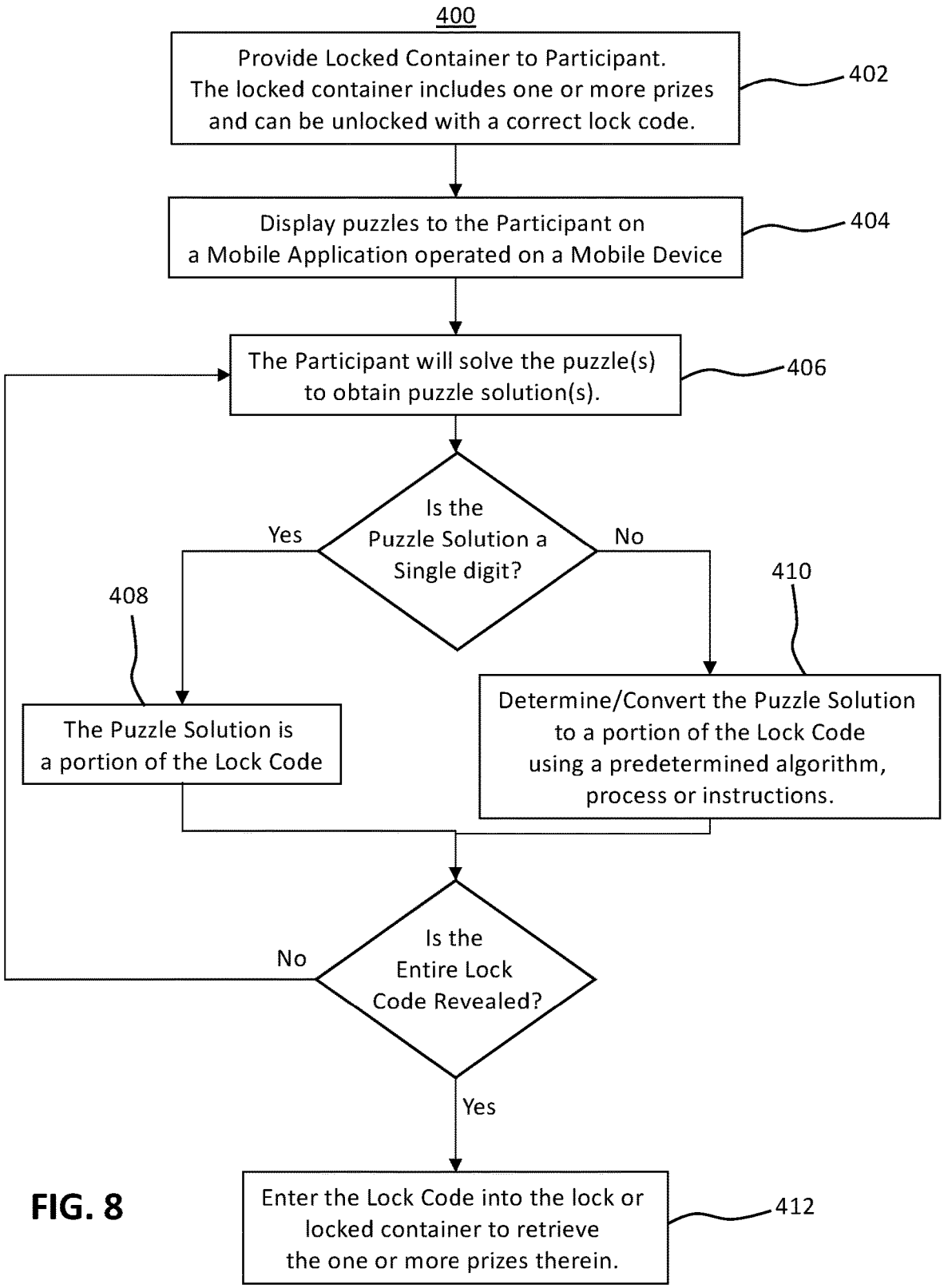
FIG. 8 is a flow chart illustrating another method of providing a lockbox puzzle game as disclosed in accordance with at least one embodiment.

FIG. 8 illustrates yet another method 400 of at least one embodiment of the present invention. For example, in this embodiment, the participant is provided a locked container 402. Using a mobile application, the participant can access the various puzzles 40A, 40B, 40C and 40D associated with the container. With reference to 406, 408 and 410, in this embodiment, the participant can manually convert or manually determine the lock code based on the puzzle solutions, similar to the discussion above in connection with 106, 108 and 110 in FIG. 4. Once the entire lock code is determined, the participant will enter the lock code into the locked container to retrieve the prize, as shown at 412.

Figure 9A:
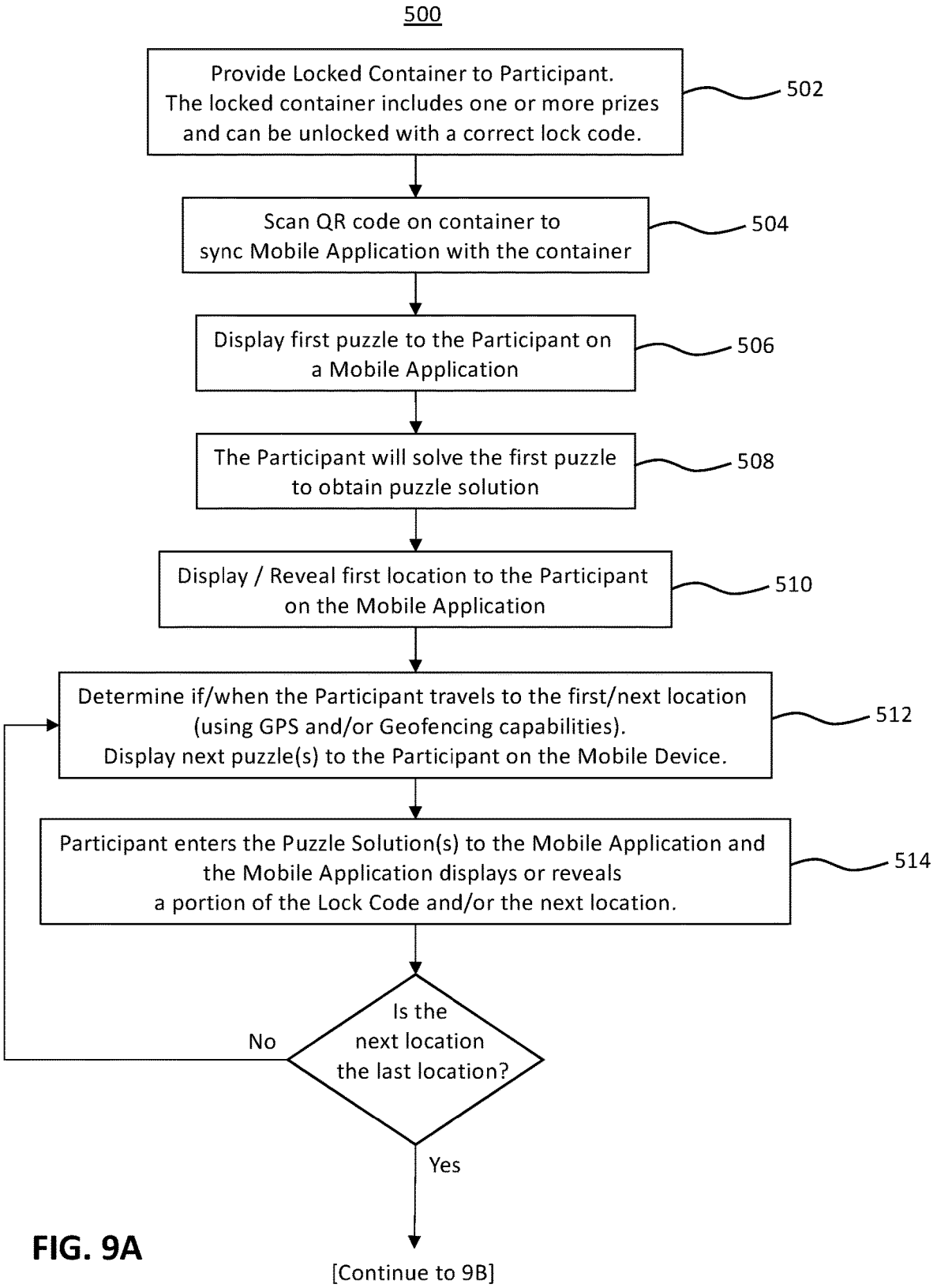
FIGS. 9A and 9B collectively represent a flow chart illustrating another method of providing a lockbox puzzle game as disclosed in accordance with at least one embodiment.
Figure 9B:
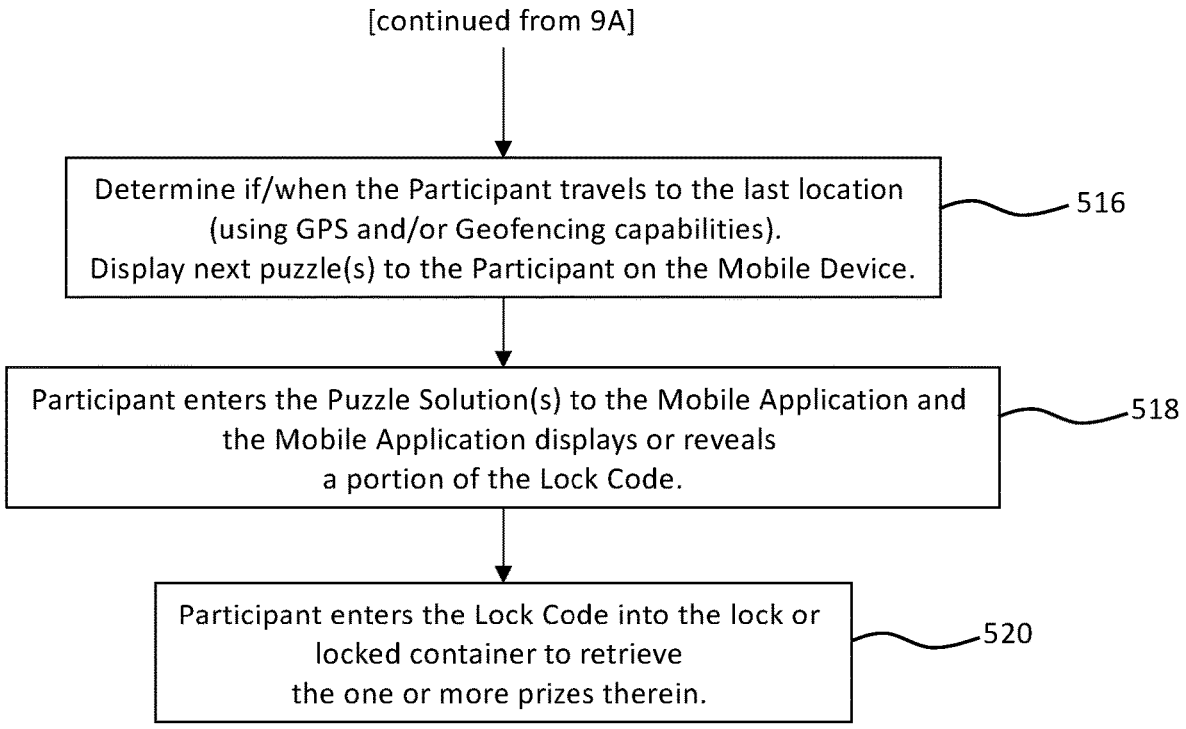
Figure 10:
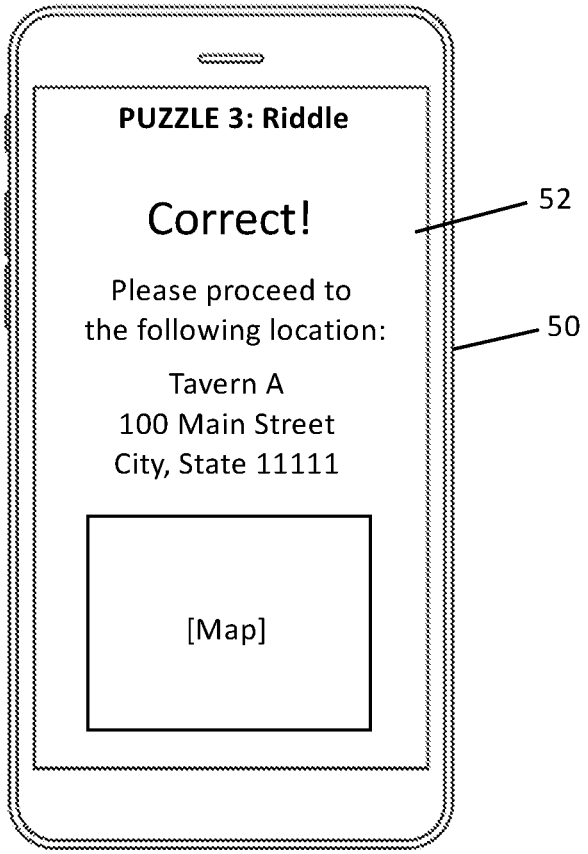
FIG. 10 is an exemplary screenshot of a mobile application displaying a first or next location, as disclosed herein.

With reference now to FIGS. 9A, 9B and 10, yet another embodiment of the present invention is illustrated. In this embodiment, the participant(s) will travel or move between various locations in order to play the game. Specifically, the method 500 of this embodiment begins by providing the participant(s) with a locked container 10 in a similar manner as in previous embodiments, as represented at 502. In some cases, the participant may need to download and install a mobile application on his or her smartphone in order to complete the game. Other embodiments may provide the participants with a mobile device that has a mobile application 52 installed or operated thereon.

In some instances, the locked container 10 may include an image or code, such as but not limited to a Quick Response (QR) code. The participant may scan the QR code 502 with the mobile device 50 in order to synchronize the mobile device to the particular locked container 10. For example, the QR code may contain identifying or unique information relative to the particular locked container 10 which will synchronize with the mobile application 52 or otherwise tell the mobile application 52 what puzzles will need to be displayed to the participant. Of course, the solutions to the puzzles are used to decipher or determine the lock code, so it is important to make sure that the puzzles shown to the participant will match the locked container 10.

In one embodiment, as shown at 506, the mobile application may display a first puzzle to the participant in a similar manner as described herein with reference to other embodiments. Once the first puzzle is solved 508, the mobile application will reveal a first location to the participant 510. With reference to FIG. 10, for example, an exemplary screenshot of the mobile application is shown illustrating that the participant entered a correct solution to the first puzzle and directing the participant to travel to a first or next location.

Using the GPS capabilities or geofencing capabilities of the mobile device, the application will determine when the participant has arrived at the first or next location, as shown at 512. When the participant has successfully traveled to the first or next location, the mobile device will display or reveal one or more puzzles. In one embodiment, as shown at 514, the method 500 or mobile application 52 will reveal two puzzles when the participant arrives at the first or next location—correctly solving one puzzle will reveal the next location and correctly solving the other puzzle will reveal a portion of the lock code in a similar manner as described in accordance with other embodiments herein.

It should be noted that other embodiments may display or reveal more or less puzzles when the participant arrives at the first or next location. For example, the method 500 or mobile application 52 may reveal one puzzle which, when correctly solved, will reveal both the next location and a portion of the lock code. In other cases, the method or mobile application may reveal three or more puzzles at a single location, revealing the next location and/or portion of the lock code when correctly solved.

The participant will continue to solve puzzles and travel to the next location until the entire lock code is determined or revealed. As shown at 516 and 518 in FIGS. 9A and 9B, if the participant is at the last location, the method 500 or mobile application 52 of one embodiment will only reveal the portion of the lock code (upon entering a correct solution to the puzzle(s)). In other words, a next location will not be revealed when the participant is at the last location.

As before, when the participant has figured out or obtained the entire lock code, as shown at 520, he or she can enter the code into the locked container 10 to retrieve the prize(s) therein.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

What is claimed is:

1. A game, comprising:

a locked container, said locked container comprising a base and a cover, said base defining an interior portion, at least one prize item disposed within said interior portion of said base, a lock initially locking said cover to said base with said at least one prize item disposed within said interior portion, wherein said lock is movable from a locked orientation to an unlocked orientation with a lock code, a plurality of puzzles and a plurality of puzzle solutions, wherein each of said plurality of puzzles is associated with a corresponding one of said plurality of puzzle solutions, wherein said plurality of puzzle solutions are used to collectively determine said lock code, wherein, if one of said plurality of puzzle solutions correlates with a format of said lock code, then said one of said plurality of puzzle solutions comprises a portion of said lock code, and wherein, if one of said plurality of puzzle solutions does not correlate with said format of said lock code, then said one of said plurality of puzzle solutions is converted to correlate with said format of said lock code using a predetermined conversion algorithm.

2. The game as recited in claim 1 further comprising at least one physical medium comprising said plurality of puzzles disposed thereon.

3. The game as recited in claim 2 further comprising a plurality of cards, wherein each of said plurality of cards comprises a separate one of said plurality of puzzles disposed thereon.

4. The game as recited in claim 2 wherein said plurality of puzzles are ordered such that said plurality of puzzle solutions of said plurality of puzzles are ordered to match an order of said lock code.

5. The game as recited in claim 1 wherein said format of said lock code comprises a series of single digits.

6. The game as recited in claim 1 further comprising a mobile application operated on a mobile device, wherein said mobile application is configured to receive one of said plurality solutions and, in response, reveal a portion of said lock code.

7. A method for presenting a game, said method comprising:

providing a locked container to a participant, the locked container comprising a base and a cover, the base defining an interior portion with at least one prize item disposed therein, the locked container being initially locked wherein the container can be unlocked via a lock code, providing a plurality of puzzles to the participant, wherein each of the plurality of puzzles comprise a puzzle solution, wherein the puzzle solution for each of the plurality of puzzles is used to determine a portion of the lock code, wherein, if the puzzle solution of at least one of the plurality of puzzles correlates with a format of the lock code, then the puzzle solution is a portion of the lock code, wherein, if the puzzle solution of at least one of the plurality of puzzles does not correlate with a format of the lock code, then converting the puzzle solution to correlate with the format of the lock code using a predetermined conversion algorithm, and when the entire lock code is determined using the puzzle solutions for the plurality of puzzles, using the lock code to unlock the locked container and retrieve the at least one prize item disposed therein.

8. The method as recited in claim 7 wherein the plurality of puzzles are provided on at least one physical medium.

9. The method as recited in claim 8 wherein each of the plurality of puzzles are provided on a separate one of a plurality of physical cards.

10. The game as recited in claim 9 wherein said plurality of physical cards are ordered such that the puzzle solutions of the plurality of puzzles are ordered to match an order of the lock code.

* * * * *